United States Patent [19]

Greutert et al.

[11] Patent Number: 4,872,266

[45] Date of Patent: Oct. 10, 1989

[54] PLASTIC FRAME WITH EMBEDDED SHEARING FOIL

[75] Inventors: Albert Greutert, Sachseln; Ruedi Gasser, Luzern, both of Switzerland

[73] Assignee: Maxs AG, Sachseln, Switzerland

[21] Appl. No.: 146,314

[22] Filed: Jan. 21, 1988

[30] Foreign Application Priority Data

Jan. 28, 1987 [DE] Fed. Rep. of Germany ..... 3702526

[51] Int. Cl.[4] ..... B26B 11/04

[52] U.S. Cl. ..... 30/346.51; 30/43

[58] Field of Search ..... 30/345–351, 30/346.54, 45, 43.8, 43.9, 43.91, 43.92

[56] References Cited

U.S. PATENT DOCUMENTS 4,133,103 1/1979 Beck ..... 30/346.51 X

FOREIGN PATENT DOCUMENTS 2203926 8/1973 Fed. Rep. of Germany ... 30/346.51

*Primary Examiner*—Frank T. Yost
*Assistant Examiner*—William Fridie, Jr.
*Attorney, Agent, or Firm*—James D. Hall; Thomas J. Dodd; Todd A. Dawson

[57] ABSTRACT

In a box-type plastic frame having longitudinal strut portions in which a vaulted shearing foil is embedded and transverse strut portions made of a resilient material in order to facilitate the insertion of the plastic frame shearing foil unit into a shearing head casing member.

5 Claims, 1 Drawing Sheet

PLASTIC FRAME WITH EMBEDDED SHEARING FOIL

SUMMARY OF THE INVENTION

This invention relates to a plastic frame having a pair of opposing longitudinal strut portions to which a vaulted shearing foil is attached and a pair of transverse strut portions to interconnect the longitudinal strut portions, the longitudinal strut portions being provided with fastening means to hold the plastic frame in a shearing foil holder of a dry shaver.

In shearing heads to be used with dry shavers, it is already known to inject the shearing foil with its longitudinal edges into the synthetic material of a plastic frame. However, to fasten a frame of such type within the casing member of the dry shaver, which accommodates the shearing foil, proved to be relatively complicated. Both insertion and removal of the combination member composed of shearing foil and plastic frame easily causes damage to the shearing foil. This invention is based on the task of so improving a plastic frame of the type described hereinbefore that the latter can be easily inserted into and removed from a shearing head casing member without causing damage to the shearing foil.

The solution of the task is attained by the fact that the transverse strut portions are made of a resilient material. It is thereby achieved that the longitudinal strut portions are elastically urged against the shearing head casing and are held in position by the fastening means. In the untensioned state, the transverse strut portions preferably assume in their longitudinal direction a shape which deviates from a straight line with the longitudinal strut portions and the transverse strut portions preferably formed of one piece.

In accordance with a preferred embodiment, the transverse strut portions are of an arc-shaped configuration and are bent either inwardly or outwardly or upwardly. By means of two fingers moved into the arc-shaped transverse strut portions, the plastic frame is elastically so deformed by applying pressure to the transverse strut portions that the distance between the longitudinal strut portions decreases, so that the plastic frame can be brought into its final position in the shearing head casing. Alternatively, the transverse strut portions may be waved.

In accordance with another embodiment, the transverse strut portions are buckled in the center thereof by being reduced in cross-section at the point of buckling. It is also possible that the reduced section is a hole which simultaneously serves as an insertion aid. The transverse strut portions may be additionally also tapered at the points where the transverse strut portions join the longitudinal strut portions. The transverse strut portions may further have at the center of their length a projecting section serving as an insertion aid. These projecting sections may be designed to be broken off.

In accordance with another advantageous embodiment, the longitudinal strut portions are bent outwardly. In conjunction with the pressure exerted by the transverse strut portions, the longitudinal strut portions are so allowed to contact the shearing head casing over their entire length. The same effect can be achieved when the transverse strut portions join the longitudinal strut portions at points remote from the ends of the longitudinal strut portions.

BRIEF DESCRIPTION OF THE DRAWINGS

The invention shall hereinafter be described in more detail in conjunction with several embodiments and with reference to schematic drawings, wherein.

DESCRIPTION OF THE PREFERRED EMBODIMENTS

Figure 1:
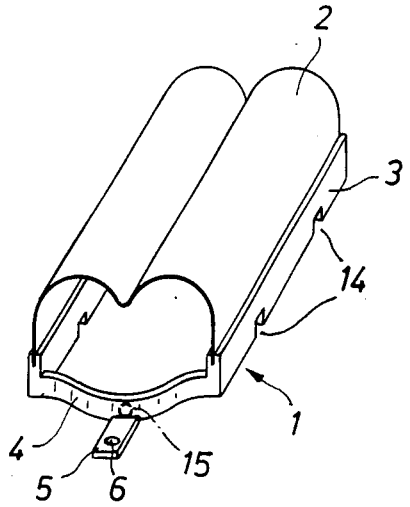
FIG. 1 shows a perspective view of a plastic frame having the shearing foil injected thereinto.

FIG. 1 shows a plastic frame 1 in which a bivaulted shearing foil 2 is fastened. The longitudinal edges of the shearing foil are snugly embedded in the longitudinal strut portions 3 of plastic frame 1.

The ends of the two longitudinal strut portions 3 are interconnected by means of slightly outwardly curved transverse strut portions 4. The longitudinal strut portions 3 and the transverse strut portions 4 may be formed of one piece and are made of a flexible synthetic material. At the center of the length of each transverse strut portion 4 is a laterally outwardly extending projecting section 5 which has a hole 6 and which serves as an insertion aid upon insertion of the plastic frame into a shearing head casing member (not shown) of a dry shaver. The projecting sections 5 may be designed to be broken off. Alternatively, each projecting section may be replaced by an indented section or a hole a 15 (shown in broken lines) at the center of the transverse strut portions 4.

Figure 2:
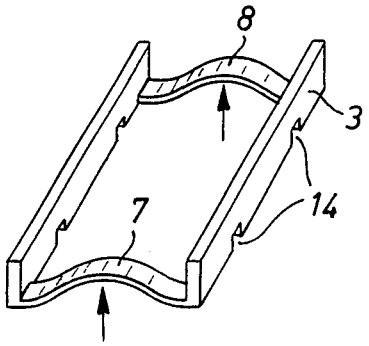
FIG. 2 shows a perspective view of a further embodiment of a plastic frame, the shearing foil having been omitted for better understanding.

FIG. 2 shows in perspective an alternative embodiment. In this case, transverse strut portions 7 and 8 are vaulted in a manner similar to that shown in the embodiment according to FIG. 1 but lie in planes extending orthogonally or transversely with respect to the longitudinal strut portions 8 and extend upward towards the shearing foil.

Figure 3:
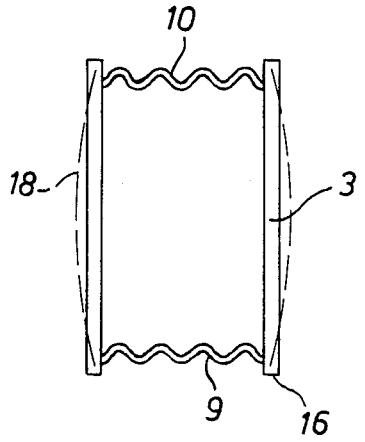
FIG. 3 and 4 are top views of further embodiments of a plastic frame.

FIG. 3 is a top view of a plastic frame which is provided with waved transverse strut portions 9 and 10. It can be seen from this figure that the transverse strut portions join the longitudinal strut portions remote or inset from the ends 16 of the latter. A bending moment can be produced on the longitudinal strut portions 3 by reason of the pressure exerted by the transverse strut portions to the longitudinal strut portions when the ends 16 of the longitudinal strut portions rest on the shearing head casing member. This causes the longitudinal strut portions 3 to be held in contact with the shearing head casing member over their entire length. As such the longitudinal strut portions are designed to assume a slightly outward bent shape as indicated by the broken lines 18 which represent the longitudinal center lines of the longitudinal strut portions.

Figure 4:
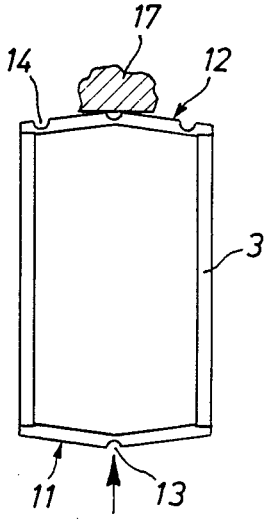

In the embodiment represented in FIG. 4, transverse strut portions 11 and 12 are buckled and have a reduced section 13 at the center of their length which ensures sufficient flectional elasticity of the transverse strut portion. As shown in the lower section of FIG. 4, the ends of the transverse strut portion 11 join the longitudinal strut portions 3 without being reduced in cross-section. As such, upon insertion of the plastic frame into a shearing head casing member when an inwardly directed force is applied to the center of the transverse strut portions 11 and 12 as shown by the arrow in FIG.

4, a turning moment is produced which endeavors to curve the longitudinal strut portions 3 outwards, so that the latter are brought into contact with the shearing head casing member over their entire length.

The upper section of FIG. 4 shows an alternative embodiment in which the transverse strut portions are also reduced in cross-section at the points or ends 14 where they join the longitudinal strut portions 3. A kind of articulated joint or knee joint is thus obtained and the insertion of the plastic frame may involve the following steps: the transverse strut portions are first bent inwards, in this condition, the plastic frame is inserted into a shearing head casing member, and the transverse strut portions are then bent outwards in a direction opposite to the direction indicated by the arrow, so that they assume the contour shown in FIG. 4. The centers of the transverse strut portions 11 and 12 may thereby be brought into contact with a zone 17 of a shearing head casing member with the zone limiting the outward movement of the transverse strut portions.

To insert the combination member shown in FIG. 1 composed of plastic frame 1 and shearing foil 2 into the corresponding casing member of a dry shaver, the transverse strut portions 4 are elastically deformed by applying outward directed pressure to the inner sides of the transverse strut portions, for example with the aid of two fingers, so that the distance between the longitudinal strut portions 3 is reduced and the plastic frame can be inserted into the appropriate opening of the casing member. After the pressure has been released from the transverse strut portions 4, the distance between the two longitudinal strut portions 3 increases so that the latter are elastically urged against the casing member with recesses 14 defined on the bottom side of the longitudinal strut portions 3 being determined to snap into accommodating projection portions of the casing member. In this manner, the plastic frame is held in the casing member in an accurately fixed position.

The combination member of FIG. 1 may be also inserted into the casing member by means of a tool, for example a long-nose pliers, the ends of which are inserted into the holes 6 of the projecting sections 5 to spread the projecting sections outward and correspondingly deform the transverse strut portions 4. The removal of the combination member is accomplished accordingly. The insertion of the plastic frame represented in FIGS. 3 and 4 and the shearing foil into a shearing head casing member with the aid of the fingers may be accomplished in a manner similar to that described with reference to FIG. 1.

To insert the plastic frame shown in FIG. 2, pressure is applied to the transverse strut portions 7 and 8 in a direction corresponding to the direction of insertion of the plastic frame into the casing member as indicated by the arrows.

The transverse strut portions of the frame may also differ from the shape and construction as shown. It is essential that the distance between the ends of each transverse strut portion can be reduced to allow the distance between the longitudinal strut portions to decrease and thus enable the latter to slide over possible holding projections in a casing member to accommodate the plastic frame with the shearing foil. The shearing foil may also have any other shape, for example it may simply be bent in the form of a cylinder jacket.

What is claimed is:

1. In combination a plastic frame and a vaulted shearing foil, said frame including a pair of opposing longitudinal strut portions to which said foil is attached and a pair of transverse strut portions interconnecting the longitudinal strut portions, the longitudinal strut portions being provided with fastening means to hold the plastic frame in a casing member of a dry shaver, characterized in that said transverse strut portions are resilient to allow movement of the longitudinal strut portions toward and away from each other, said transverse strut portions having an untensioned state which in their longitudinal direction deviates from a straight line, said transverse strut portions each including a center section reduced in cross-section to accommodate buckling of the transverse strut portions.

2. The combination of claim 1, characterized in that said center section is defined by a hole means for accommodating a device to aid in insertion of the frame into said casing member.

3. The combination according to claim 1, characterized in that the transverse strut portions each include end sections reduced in cross-section adjacent their junctions with said longitudinal strut portions.

4. The combination according to claim 1, characterized in that each transverse strut portion is provided at its midlength with a projection means for accommodating a device to aid in insertion of the frame into said casing member.

5. The combination according to claim 4, characterized in that said projection means is separatable from the remainder of its connected transverse strut portion.

* * * * *